US006666360B1

(12) United States Patent
Swank

(10) Patent No.: US 6,666,360 B1
(45) Date of Patent: Dec. 23, 2003

(54) PERSONAL HYDRATION SYSTEM FOR RUNNERS

(76) Inventor: Michael W. Swank, 8181 Fannin, Apt. 1331, Houston, TX (US) 77054

( * ) Notice: Subject to any disclaimer, the term of this patent is extended or adjusted under 35 U.S.C. 154(b) by 0 days.

(21) Appl. No.: 10/331,305

(22) Filed: Dec. 31, 2002

(51) Int. Cl.[7] ..... A45F 5/00

(52) U.S. Cl. ..... 224/148.2; 222/175; 224/148.4; 224/148.5; 224/901.8

(58) Field of Search ..... 224/148.2, 148.4, 224/148.5, 148.6, 901.8; 222/175

(56) References Cited

U.S. PATENT DOCUMENTS

| | | | | |
|---|---|---|---|---|
| 4,090,650 A | * | 5/1978 | Gotta | 224/148.2 |
| 4,139,130 A | | 2/1979 | Glusker et al. | |
| 4,174,717 A | | 11/1979 | Schreiber et al. | |
| 4,526,298 A | | 7/1985 | Boxer et al. | |
| 5,060,833 A | | 10/1991 | Edison et al. | |
| 5,085,349 A | * | 2/1992 | Fawcett | 224/148.2 |
| 5,104,016 A | * | 4/1992 | Runkel | 224/148.2 |
| 5,207,362 A | | 5/1993 | Janus et al. | |
| 5,427,290 A | | 6/1995 | Thatcher | |
| 5,431,308 A | * | 7/1995 | Tchen | 222/175 |
| 5,566,869 A | | 10/1996 | Katz | |
| 5,571,260 A | | 11/1996 | Krug | |
| 5,645,404 A | | 7/1997 | Zelenak | |
| 5,938,089 A | | 8/1999 | Abreu-Marston | |
| 5,941,640 A | | 8/1999 | Thatcher | |
| 5,984,145 A | * | 11/1999 | McAllister | 222/175 |
| 6,099,382 A | | 8/2000 | Wilson | |
| 6,126,041 A | | 10/2000 | DiTomasso et al. | |
| 6,220,490 B1 | | 4/2001 | O'Hara | |
| 6,241,135 B1 | | 6/2001 | Thatcher | |
| 6,241,575 B1 | | 6/2001 | Shailer | |
| 6,247,619 B1 | | 6/2001 | Gill et al. | |
| D444,295 S | | 7/2001 | Malik et al. | |
| 6,409,048 B1 | | 6/2002 | Belzeski | |
| 6,598,770 B2 | * | 7/2003 | Bolts | 224/148.2 |

OTHER PUBLICATIONS www.camelbak.com—FlashFlo™ bladder waist pack.
www.fuelbelt.com—Fuel Belt™ multi–bottle waist systems.
www.gregorypacks.com—Bottle waist packs.
www.hydrastorm.com—HydraStorm™ bladder waist pack.
www.411hydration.com.—Liquid Assets™ bladder waist pack.
www.nathansports.com—Bladder and bottle waist packs.
www.ultimatedirection.com—Bladder waist packs.

* cited by examiner

*Primary Examiner*—Gary E. Elkins

(57) ABSTRACT

An improved hydration system for runners that provides superior motion control and easy dispensing. Fluid is contained within a flexible bladder and pack, and attached to the waist. The pack is constructed of comfortable, elastic, and thermally-insulating fabric. When attached to the waist, tension in the fabric compresses the bladder against the user and dampens motion. Uniform distribution of fluid in the bladder contributes to motion control and is provided by a flexible plastic compression plate and snap elements that pinch the lower portion of the bladder. The snap elements can be disengaged to allow the bladder to be fully expanded for easy cleaning and drying. Fluid is dispensed from a small waist-mounted squeeze bottle that fills automatically from the bladder via fluid coupling elements. Check valves ensure that fluid flows unidirectionally from bladder to bottle to user, and prevent air infiltration into the squeeze bottle and bladder.

12 Claims, 7 Drawing Sheets

PERSONAL HYDRATION SYSTEM FOR RUNNERS

FEDERALLY SPONSORED RESEARCH

Not Applicable

SEQUENCE LISTING OR PROGRAM

Not Applicable

BACKGROUND

1. Field of Invention

This invention relates to the field of personal hydration systems used by runners or joggers.

2. Discussion of Prior Art

Running, cycling, and other forms of exercise produce an increased need for water intake to compensate for that lost by respiration, perspiration, and urinary output. This need, if not met, may become life threatening during prolonged high-intensity activity in hot weather. It is therefore desirable to be able to carry on one's person an adequate supply of water or other hydrating fluid.

Although hydration systems are in common use by cyclists, prior art hydration systems for runners have not met two essential design criteria. One is that the device must utilize a stable, non-irritating waist-mounted system with sufficient motion control to minimize bounce and sway. Another is that the device must provide a simple, lightweight, and inexpensive means for delivering fluid from waist level to mouth level.

One type of hydration system for runners utilizes one or more water bottles attached to a waist-mounted belt. U.S. Pat. Nos. 6,241,135 and D444,295 describe similar waist-mounted bottle/flask systems. One problem with this type of system is that the bottles are rigid, and the center of mass of the attached water bottles is relatively far from the center of mass of the runner. Furthermore, as the bottles are drained with use, water is free to slosh about. Consequently, it is difficult to provide motion control for these bottles, and the bouncing of the rigid bottles against the user is uncomfortable.

Personal hydration systems used by cyclists employ a flexible bladder encased in a fabric pack and mounted upon the cyclist's back with shoulder straps. Fluid is delivered by a tube with a bite-valve that delivers fluid when the user bites down on the end; one embodiment of this type of hydration system is disclosed in U.S. Pat. No. 5,060,833. Because of the bent-over posture of a cyclist, the elevated position of the pack relative to the user's mouth creates a hydrostatic head that allows for gravity-driven flow of fluid from the pack to the user's mouth. Although this type of hydration system has seen widespread use among cyclists, runners have not embraced this type of system for two important reasons: lack of motion control and difficulty in drawing water from back level to the mouth level due to the upright posture of the runner. Although such a device, when mounted on the back, is suitable for a cyclist whose body remains relatively stable in both the horizontal and vertical planes, the lack of motion control makes it unsuitable for a runner, whose torso tends to oscillate, creating unacceptably large oscillations of the pack in the vertical (bounce) and horizontal (sway) directions. This motion of the pack can chafe the user, and fatigue the upper back, neck, and shoulder muscles. There is little that can be done to increase the amount of motion control of a back-mounted pack, as increased strap tension produces unacceptable stress on the user's neck, back, and shoulder muscles. Furthermore, because of the upright posture of the runner, the pack is located below the user's mouth, and the loss of a hydrostatic head results in a need to draw water by suction, a difficult task when running.

Manufacturers of back-mounted hydration packs have attempted to adapt these devices for runners so that they may be worn about the waist or hips. These waist-mounted packs are essentially back-mounted designs retro-fitted with a waistband, designed without consideration of the unique needs of runners. Because of the lower center of gravity relative to back-mounted packs, placement of a hydration pack at waist level is desirable. However, this placement makes it difficult to draw the fluid to mouth level, as it requires an unacceptably high amount of suction from the user to draw the liquid from waist level to mouth level. One possible solution to this problem is to include a pump to force the liquid to mouth level; U.S. Pat. Nos. 5,645,404 and 5,571,260 describe similar devices. However, the inclusion of a pump and its obligatory power supply results in disadvantages of both increased weight and cost. Another approach is to pressurize the bladder; U.S. Pat. No. 6,409,048 utilizes compression plates on opposing sides of the bladder, and compression is achieved by a number of straps which must all be cinched up in order to squeeze the two plates together. However, this design presents several problems. As fluid is drained, the straps must be continually tightened to maintain pressure, a cumbersome task. The plates must also be stiff, turning the bladder into an uncomfortable rigid body.

Because a cyclist has little body motion relative to a runner, a back-mounted pack can be attached with loose shoulder straps. Furthermore, since there is little motion of the pack relative to the user's back, the pack can be constructed of non-elastic woven nylon or polyester fabric. However, running produces substantial running-related movement of the muscles about the waist and hip area. To achieve sufficient motion control, the waistband must be cinched tight to prevent motion of the pack. However, as the tension of the waistband increases, so too does the pressure on the user's muscles, tendons, and other tissue. Thus, the user of such packs is faced with a dilemma: if too loose, the pack will have too much motion, and if too tight, the result is discomfort and possible injury. Since the tissue of the waist area is in motion, the pack itself must be sufficiently pliant so that it can move with the runner. Non-elastic fabric does not allow for this, and may represent a potential source of repetitive stress injury to runners who use such systems.

Another problem that arises with the use of non-elastic cloth relates to the ability of the fabric to prevent motion of the bladder within the fabric pack. The basic design of prior art packs is a bladder within a fabric bag. Because the fabric is non-elastic, the maximum tension against the bladder is achieved only when the bladder is completely filled. As fluid is drained from the bladder, the volume of the bladder decreases, but the volume of the fabric bag does not. The bladder is thus free to bounce around, producing additional motion of the entire system. Numerous systems utilize additional straps to take up the slack created by decreasing bladder volume, however, these must be continually tightened, a cumbersome task.

One means by which to achieve motion control is to make the attached object an integral part of the runner's body such that the amplitude of motion is reduced and more in phase with the runner. A consideration of the problems faced by women runners may be informative. Breast tissue has fluid properties, and running produces considerable motion of the tissue. The solution to this problem is provided by athletic bras designed to restrain the breast by compression against the body, an effect accomplished through the means of snug-fitting elastic fabric as shown in U.S. Pat. No. 4,174,717. This compression decreases the moment of inertia of the tissue by reducing the distance of the center of mass of the tissue to the center of mass of the subject. The elastic fabric also dampens tissue motion. The physical properties of a flexible fluid-filled bladder suggest that a similar design would work in a waist-mounted hydration system.

Delivery of fluid from waist-level to the mouth presents additional obstacles. It is not possible to use a tube delivery device while running, as this requires prohibitively large suction forces that are impossible to generate while breathing at a high rate. However, unlike cyclists, runners are free to use their hands, and it is common practice during races to provide water in disposable cups. Cups are problematic, though, as it is easy both to spill their contents and to accidentally choke when running. Squeeze bottles present less risk of spillage and choking, but are rigid, bulky, and uncomfortable due to excessive motion. Smaller bottles bounce around less, but at the cost of reduced capacity. Some designs utilize multiple small squeeze bottles to increase total fluid capacity. However, these devices are bulky and uncomfortable, and it is awkward to clean and fill multiple bottles. Furthermore, infiltration of air to displace dispensed fluid produces sloshing regardless of the size of the bottle.

Prior art hydration systems suffer from a number of additional problems. Because of the flexible nature of the bladder, fluid pools in the bottom of the bladder. This produces an uneven distribution of the fluid within the bladder, producing sloshing as a result of the increased moment of inertia of the fluid. U.S. Pat. No. 5,427,290 discloses a back-mounted system that attempts to remedy this with a baffle in the lower portion of a flexible bladder. The resultant bladder is difficult to clean and dry, however, as a large portion of the inner and outer face of the bladder remains in permanent apposition. This presents a potential health hazard, as residual fluid in the bladder can support the growth of mold and other harmful microorganisms.

Given that hydration systems are most useful in hot weather, thermal insulation is essential to prevent fluid warming. However, all prior art packs employ a design in which additional thermal insulation is sewn into the fabric pack, and this increases the complexity and cost of construction. Ideally, the fabric would not only have the desired mechanical properties, but would also provide thermal insulation without the need for additional fabric layers.

OBJECTS AND ADVANTAGES

It can be seen that prior-art hydration systems for runners suffer from a number of problems, including:

a) insufficient motion control resulting from inefficient immobilization and attachment of the bladder and pack;

b) insufficient motion control resulting from air infiltration into bottles, resulting in sloshing;

c) discomfort due to inelastic fabric;

d) inability to deliver fluid to the user's mouth in an efficient manner;

e) inefficient incorporation of thermal insulation.

Accordingly, several objects and advantages of the present invention include:

a) to provide a means for attaching a flexible fluid-filled bladder to the waist such that motion of the bladder is dampened and minimized by compression against the runner's body;

b) to prevent pooling of liquid in the lower portion of the bladder while maintaining ease of cleaning and air drying of the bladder;

c) to provide a means for attaching the flexible fluid-filled bladder to the waist such that the pack is comfortable and does not irritate sensitive underlying tissue;

d) to provide efficient incorporation of thermal insulation to the hydration system;

e) to provide a means for delivery of fluid from the fluid-filled bladder to the mouth of the user via a small squeeze bottle that is securely attached to the waist, fits easily in the hand, and can be removed from the waist and raised to the mouth of the user for dispensing;

f) to provide a means for automatic filling of the squeeze bottle from the flexible bladder attached to the waist;

g) to provide a means for the prevention of air infiltration into the system to prevent sloshing.

Other objects and advantages will become apparent from a consideration of the following description and drawings.

SUMMARY

The following invention is a personal hydration system designed for runners and joggers, and consists of a flexible bladder that contains potable fluid. The bladder is enclosed in a flexible, elastic fabric pack and fastened about the waist of the user. The flexible fluid-filled bladder is constrained by compression against the user's body by the tensioned outer fabric layer of the pack. Because tension in the elastic outer fabric layer is maintained automatically as the bladder volume decreases with fluid consumption, compression of the bladder against the user's body is maintained at all times, providing constant motion control. A semi-rigid plastic compression plate fits between the bladder and the outer fabric layer of the pack, providing uniform distribution of force against the bladder. Snaps pinch the lower portion of the bladder together at a point, and prevent fluid from pooling in the lower half of the flexible bladder. Fluid is delivered to the mouth of the user by means of a small squeeze bottle mounted on the waist and connected to the main reservoir by a tube that provides automatic filling of the squeeze bottle. One-way check valves bias fluid flow from the main bladder to the squeeze bottle and to the user's mouth, thus preventing air infiltration into either the satellite bottle or main bladder, a feature that eliminates sloshing. The bottle is easily removed to deliver fluid to the mouth of the user, and is easily attached to the waist when not in use. Because the squeeze bottle has a small mass and is attached firmly to the user's waist when not in use, it does not produce any appreciable motion when running.

DRAWINGS

Drawing Figures

Figure 5A:
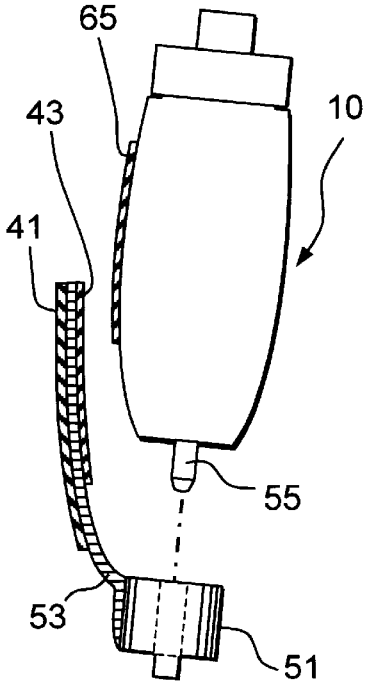
Figure 5B:
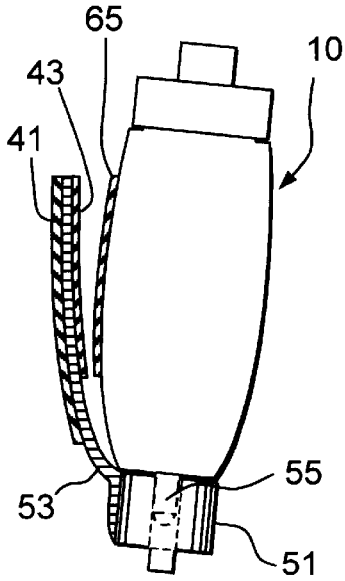
Figure 5C:
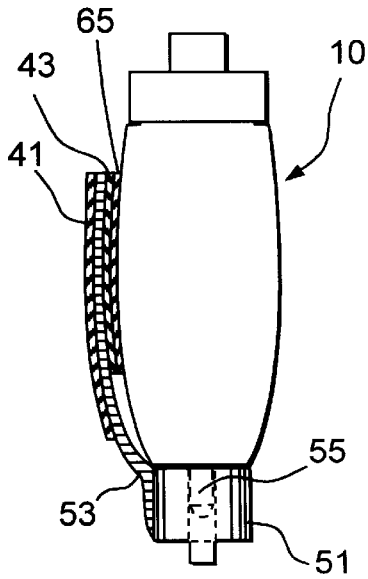

FIGS. 5A, 5B, and 5C are fragmentary side elevation views showing how the squeeze bottle is mounted and removed from the socket support panel.

Figure 1:
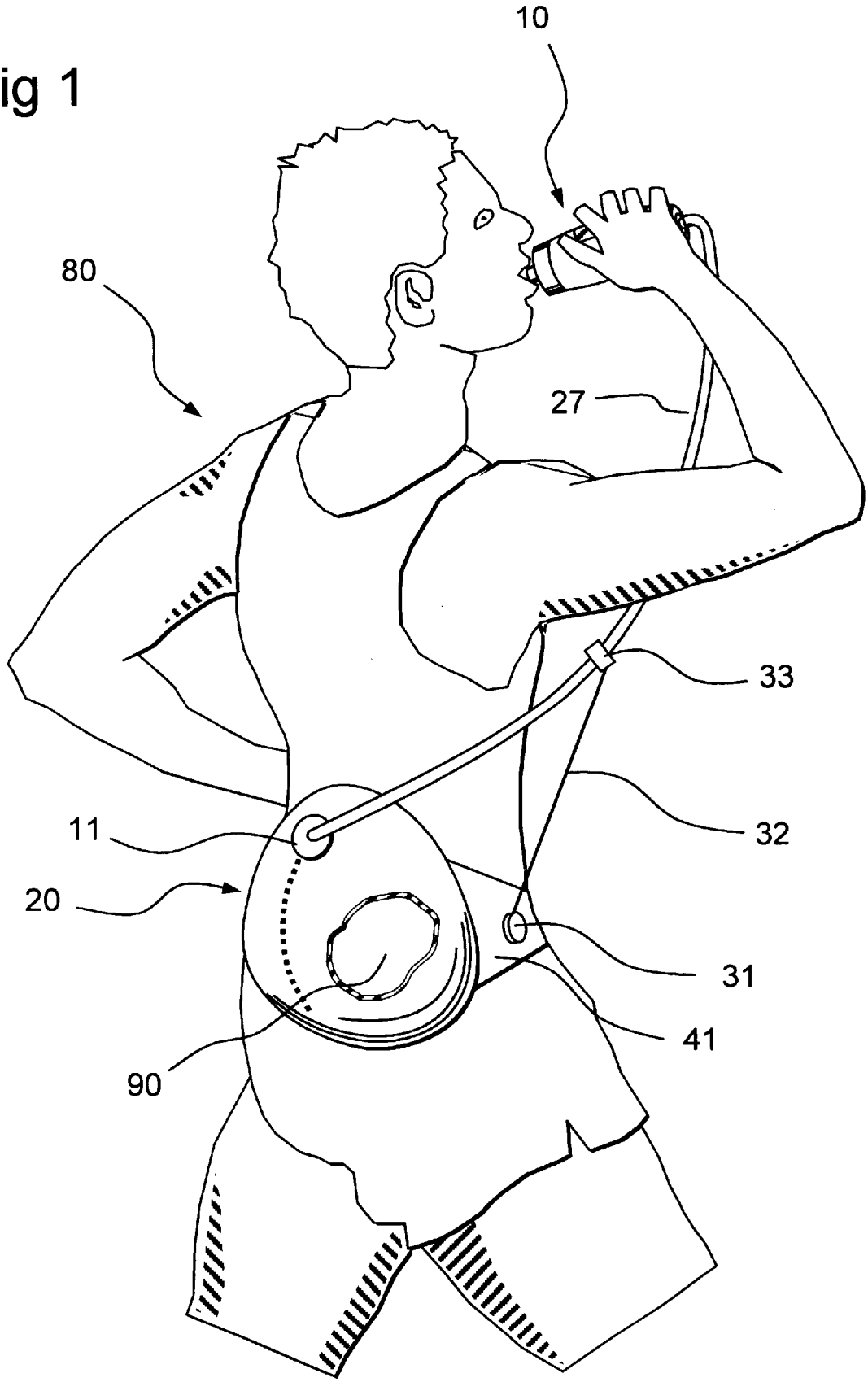
FIG. 1 is a perspective view of the present invention in use by a runner.
Figure 2:
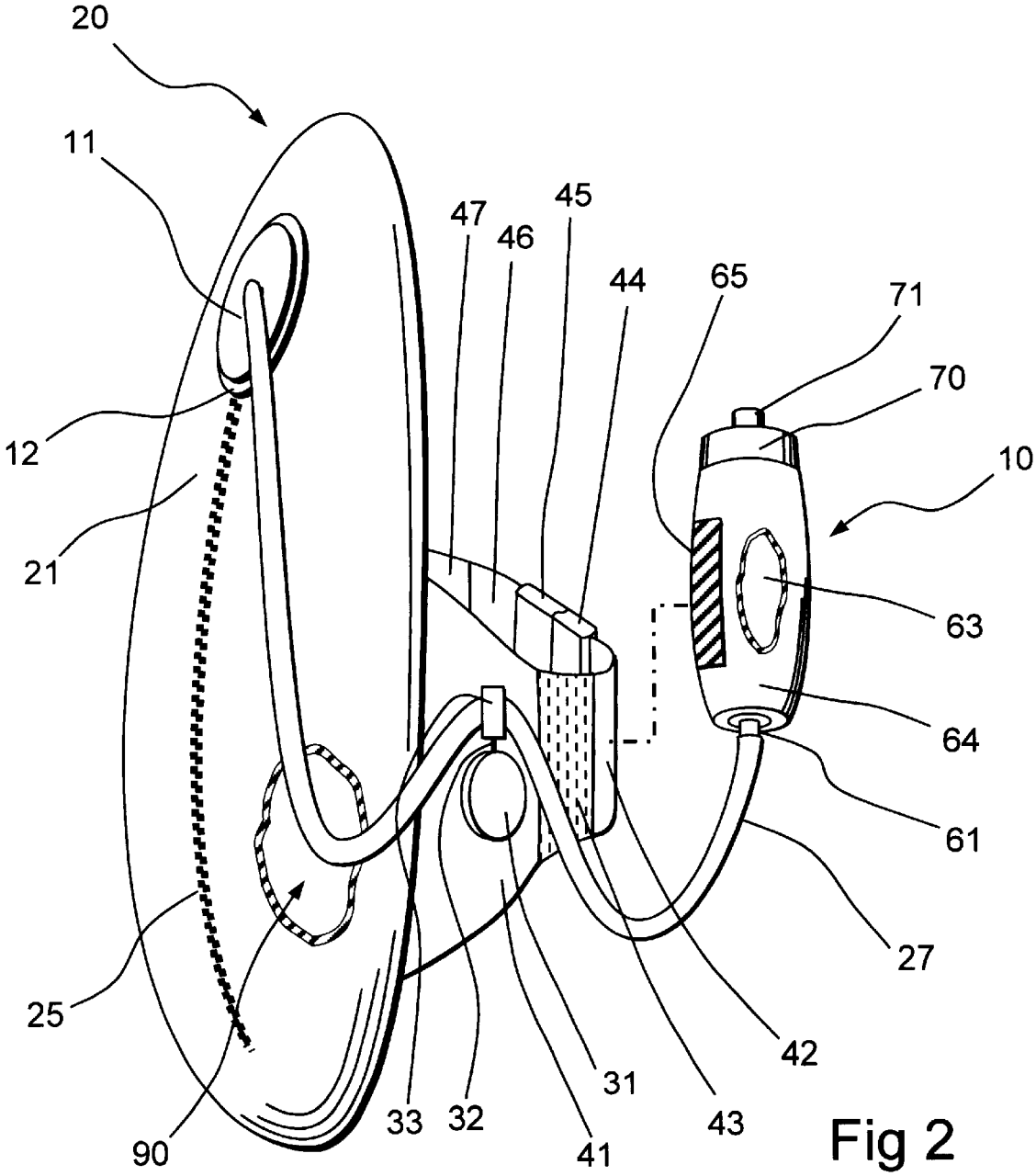
FIG. 2 is a perspective view of the invention.
Figure 3:
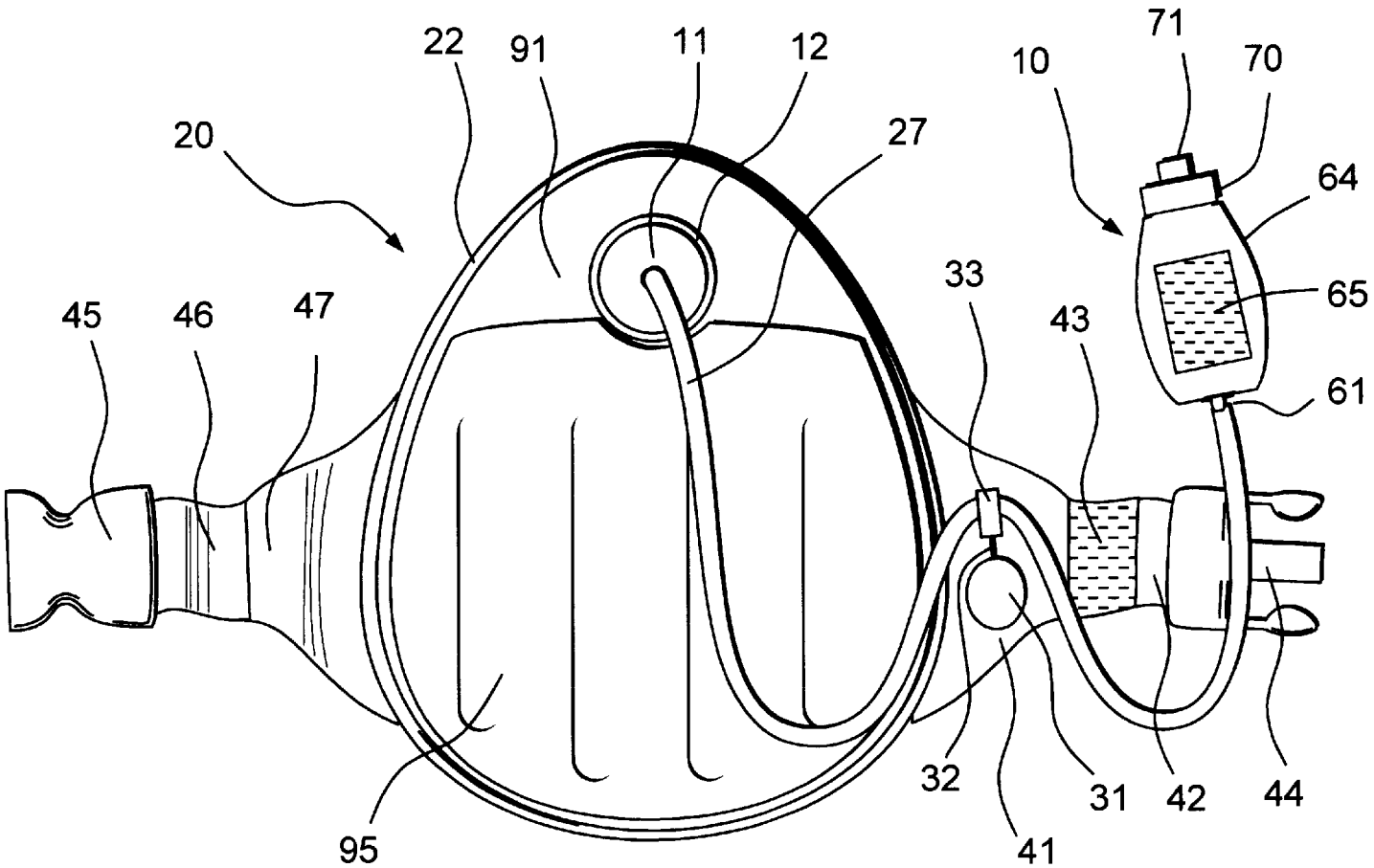
FIG. 3 is a front elevation view with the front fabric removed to reveal the inner components of the pack.
Figure 6A:
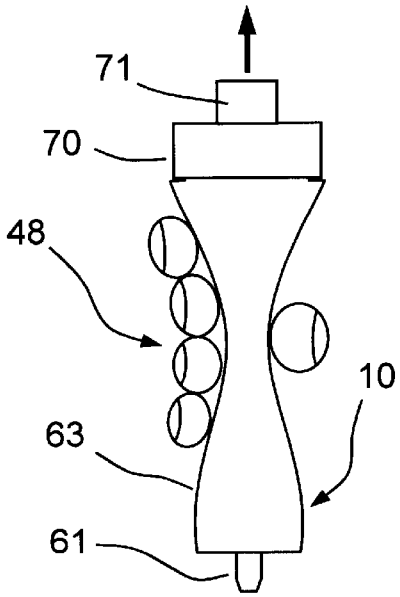
Figure 6B:
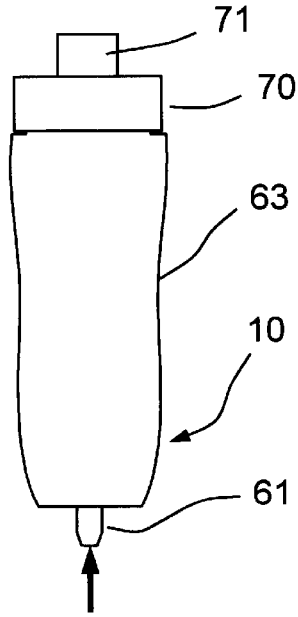

FIGS. 6A and 6B are schematic representations of dispensing from and filling the squeeze bottle shown in FIGS. 1, 2, and 3.

Figure 7A:
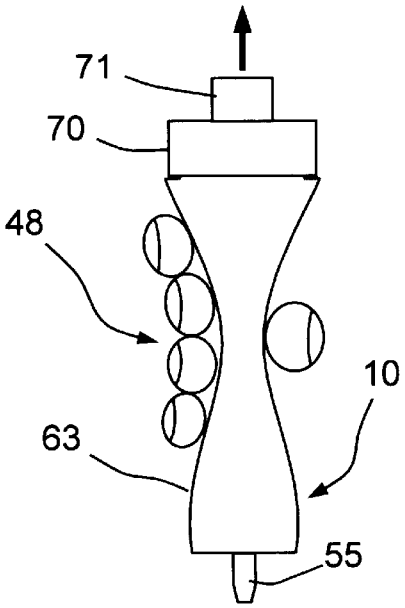
Figure 7B:
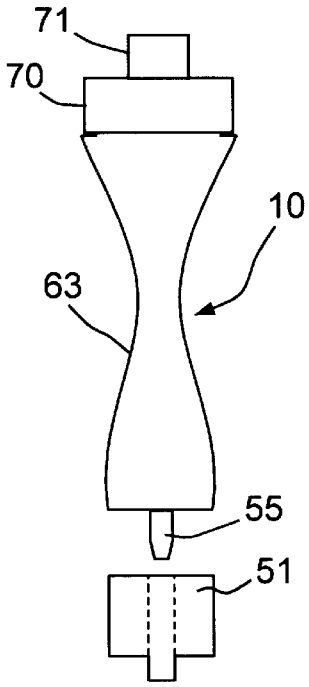
Figure 7C:
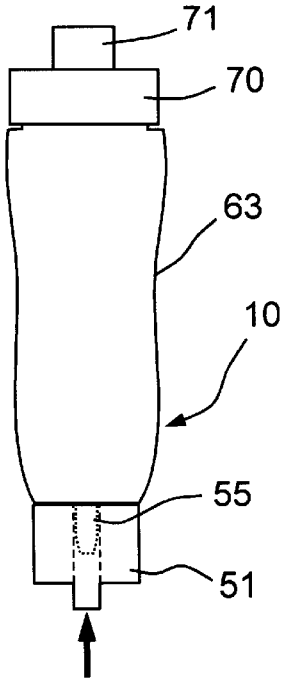

FIGS. 7A, 7B, and 7C are schematic representations of dispensing from and filling of the squeeze bottle shown in FIGS. 4, 5A, 5B, and 5C.

Figure 8A:
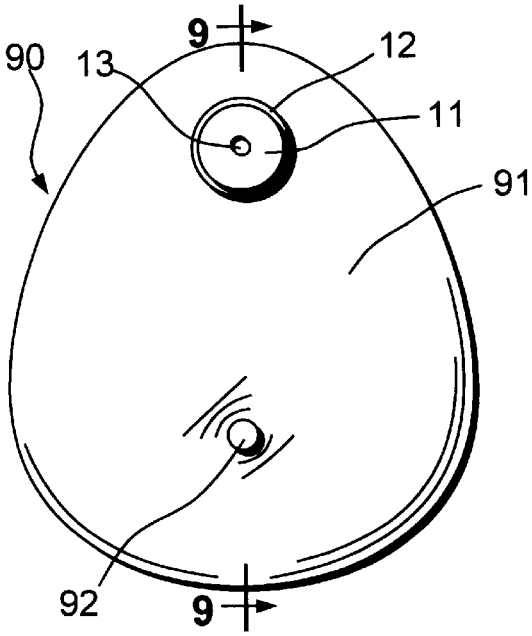
Figure 8B:
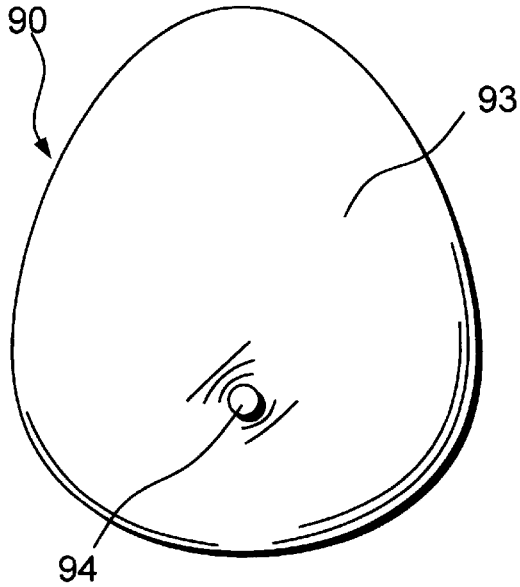

FIGS. 8A and 8B show front elevation and rear elevation views of the bladder respectively.

Figure 9A:
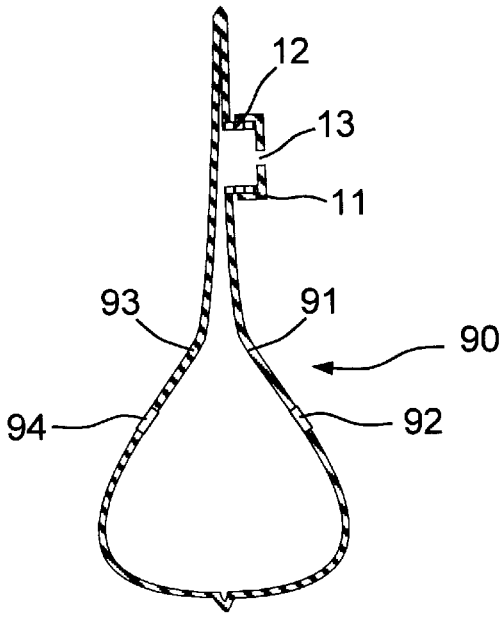
Figure 9B:
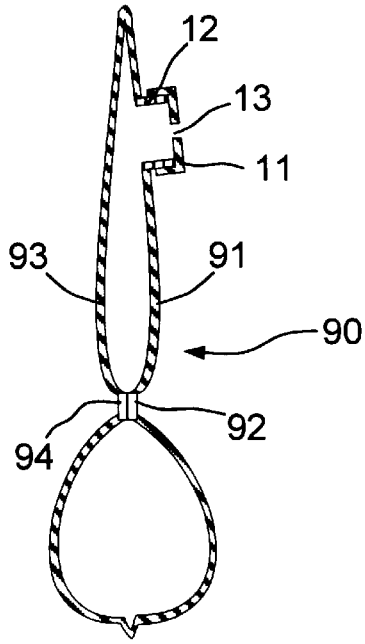

FIGS. 9A and 9B are cross-sectional views taken about line 9 of FIG. 8A and show the effect of engaging the snap fastener elements on the distribution of fluid in the bladder.

Figure 10A:
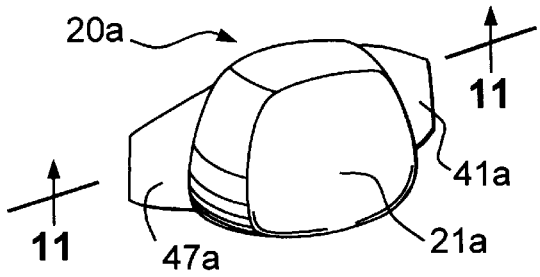

FIG. 10A is a fragmentary perspective view of a prior art hydration pack.

Figure 10B:
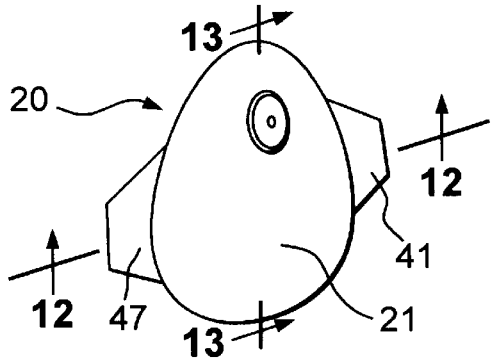

FIG. 10B is a fragmentary perspective view of the hydration pack.

Figure 11A:
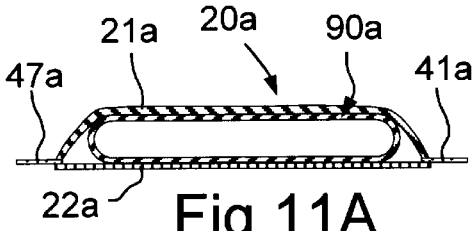

FIG. 11A is a cross-sectional view about the line 11 of FIG. 10A showing the loading of the pack with a full bladder.

Figure 11B:
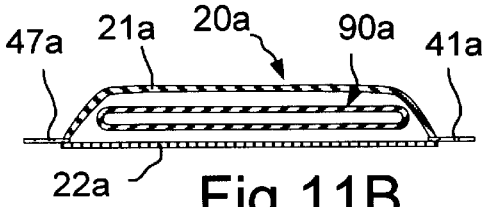

FIG. 11B is a cross-sectional view about the line 11 of FIG. 10A showing the loading of the pack with a partially empty bladder.

Figure 12A:
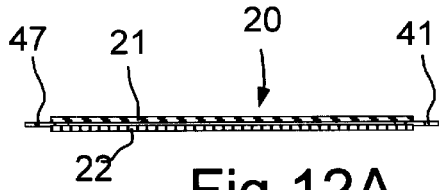

FIG. 12A is a cross-sectional view about the line 12 of FIG. 10B showing the pack before insertion of bladder.

Figure 12B:
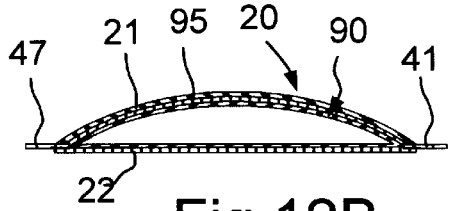

FIG. 12B is a cross-sectional view about the line 12 of FIG. 10B showing the loading of pack with a full bladder.

Figure 12C:
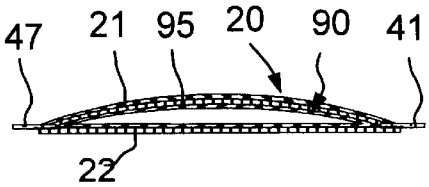

FIG. 12C is a cross-sectional view about the line 12 of FIG. 10B showing the loading of the pack with a partially empty bladder.

Figure 13:
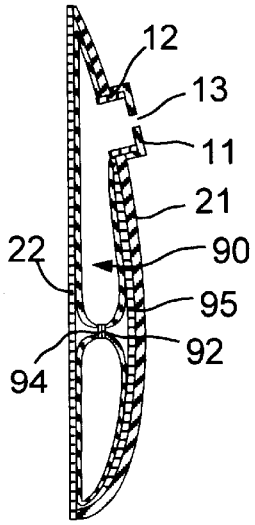

FIG. 13 is a cross-sectional view about the line 13 of FIG. 10B showing the effects of the snap elements and the compression plate on the distribution of fluid within the bladder.

REFERENCE NUMERALS IN DRAWINGS

| | |
|---|---|
| 10 | Squeeze bottle assembly |
| 11 | Bladder cap |
| 12 | Bladder opening |
| 13 | Cap orifice for tube insertion |
| 20 | Hydration pack |
| 21 | Outer fabric layer |
| 21a | Outer fabric layer - prior art |
| 22 | Inner fabric layer |
| 25 | Zipper |
| 27 | Outlet hose |
| 31 | Badge reel |
| 32 | Badge reel cord |
| 33 | Badge reel clip |
| 41 | Right side elastic fabric waistband |
| 41a | Right side fabric waistband - prior art |
| 42 | Right side buckle strap |
| 43 | Hook fastener |
| 44 | Right buckle element |
| 45 | Left buckle element |
| 46 | Left side buckle strap |
| 47 | Left side elastic fabric waistband |
| 47a | Left side fabric waistband - prior art |
| 48 | Fingers of user's hand |
| 51 | Quick-connect socket |
| 53 | Socket support panel |
| 55 | Quick-connect insert |
| 61 | Bottle inlet check valve |
| 63 | Squeeze bottle body |
| 64 | Insulated cover for bottle |
| 65 | Loop fastener |
| 70 | Squeeze bottle cap |
| 71 | Bottle outlet check valve |
| 80 | Runner |

-continued

| | |
|---|---|
| 90 | Bladder |
| 90a | Bladder - prior art |
| 91 | Bladder - front face |
| 92 | Front snap element |
| 93 | Bladder - rear face |
| 94 | Rear snap element |
| 95 | Compression plate |

DETAILED DESCRIPTION

FIG. 1 broadly discloses a runner 80 using the present invention, which consists of a pack 20 mounted about the waist and which holds a bladder 90 filled through a cap 11 and which contains fluid for drinking. The fluid is delivered to a small removable squeeze bottle assembly 10 by means of a hose or tube 27. The squeeze bottle 10 is mounted on the waist when not in use and raised to the mouth for dispensing as shown. In the present embodiment the hose 27 is continuous from the cap 11 to the squeeze bottle 10 and is restrained by a badge reel 31 attached to an elastic fabric waist band 41; the badge reel 31 contains a retractable cord 32 which attaches to the tube 27 by a small clip 33.

FIG. 2 is a more detailed view of the invention. The bladder 90 is contained within the pack 20 which is composed of two layers of fabric, with an outer layer 21 being shown here. The bladder 90 is removed from and inserted in the pack 20 via a zipper 25. The bladder 90 is filled via an opening 12 and sealed by means of the cap 11 which can be either threaded or snap-on. The tube 27 inserts into the cap 11, and the lumen of the tube 27 is contiguous with the fluid-filled interior of the bladder 90. The bottle assembly 10 broadly describes a plastic squeeze bottle 63 encased in an insulating fabric 64 with a cap 70 and an outlet check valve or spout 71. The tube 27 attaches to the bottle assembly 10 via an inlet check valve 61 with integral fitting. The check valve 61 is secured into the bottom of the squeeze bottle 63. Fluid is dispensed from the bottle 63 via the outlet check valve or spout 71. The bottle 63 is enrobed in the insulating fabric 64, which in the preferred embodiment is neoprene fabric. The insulating fabric layer 64 has attached to it a Velcro™ loop fastener 65 which allows attachment of the bottle assembly 10 to a Velcro™ hook fastener 43 attached to the right side fabric waistband 41. The badge reel 31 attached to the fabric waistband 41 contains the retractable cord 32 which attaches to the tube 27 via the small clip 33. The pack 20 is mounted about the waist by means of a left side fabric waistband 47 which is attached to the left side of the pack 20 on one end and attaches on the other end to a left side buckle strap 46 which is attached to a left buckle element 45. The right side elastic fabric waist band 41 which is attached to the right side of the pack 20 on one end attaches on the other end to a right side buckle strap 42 which attaches to a right side buckle element 44. The left buckle 45 and the right buckle 44 snap together to constrain the pack 20 about the waist of the user 80.

FIG. 3 shows the pack 20 with the front fabric 21 removed. An inner fabric layer 22 is joined to the front fabric 21 by a seam about the periphery and apposes the back of the user 80. The inner and outer fabric layers are ideally made from neoprene fabric, which provides the desired mechanical properties as well as thermal insulation to prevent the fluid from warming. The bladder 90 is composed of a front face 91 seen here and in FIG. 8B and a rear face 93 seen in FIG. 8B; the front and rear face are composed of flexible water-impermeant sheeting or membrane joined at the perimeter to define an inner compartment to hold fluid. The bladder 90 is filled via the opening 12 and sealed with the cap 11. The tube 27 inserts into the cap 11 at one end and attaches to the bottle 10 at the opposite end via the check valve 61. The tube 27 is of sufficient length to allow the squeeze bottle 10 to be raised to mouth level, and is restrained when not in use by the badge reel 31 attached to the right side elastic waist band 41. The badge reel 31 contains the retractable cord 32 that attaches to the tube 27 via the clip 33. The bottle 10 is composed of the squeeze bottle 63 which in this view is obscured by the insulating fabric 64, and is attached to the pack 20 via the bottle-attached loop fastener 65 and the waist-mounted hook fastener 43. The top of the squeeze bottle 63 is covered with the cap 70 to allow cleaning and drying when not in use. Fluid is dispensed from the bottle 10 via the outlet check valve 71 that allows flow of fluid only from the bottle, thus preventing infiltration of air back into the bottle. The front fabric layer 21 and rear fabric layer 22 of pack 20 are attached on each side to the left fabric waistband 47 and the right fabric waistband 41 which are attached respectively to the buckle straps 46 and 42 which attach respectively to the left buckle 45 and the right buckle 44 elements which are then connected or coupled in the front of the user 80. Because of the elastic nature of the outer fabric layer 21 and inner fabric layer 22, when the pack 20 is mounted about the waist, tension is generated in the inner fabric layer 22 and the outer fabric layer 21, exerting a compressive force upon the front bladder face 91. A flat plastic panel or compression plate 95 acts to distribute the pressure of the outer fabric layer 21 against the front bladder face 91.

Figure 4:
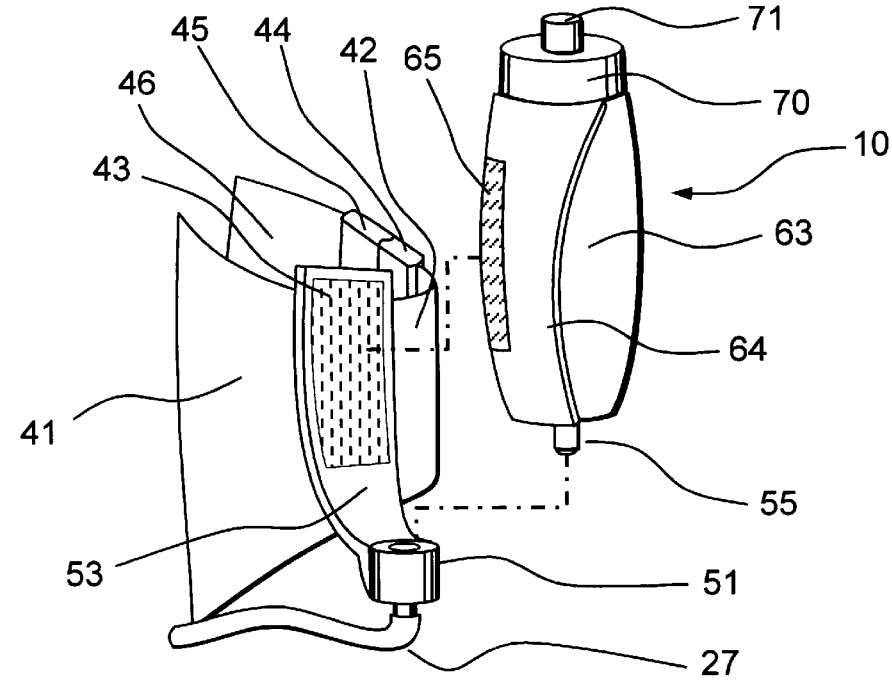
FIG. 4 is a fragmentary perspective view of the attachment of the squeeze bottle to the quick-connect socket.

FIG. 4 demonstrates an alternate embodiment of the invention. As with the previous descriptions, the bottle assembly 10 comprises the squeeze bottle 63, which is covered by the insulating fabric 64. Fluid is dispensed via the check valve nozzle or spout 71 attached to the cap 70, and the bottle is filled via the tube 27. The tube 27 attaches to a quick-connect fluid coupling socket element 51 which is mounted on a plastic socket support panel 53 that attaches by stitching, adhesive, or riveting to the right buckle strap 42. The bottle 10 attaches to the socket support panel 53 via the bottle-attached loop fastener 65 which attaches to the hook fastener 43 attached by adhesive or stitching to the socket support panel 53. A quick-connect fluid coupling insert 55 is attached to the bottle 63. The quick-connect insert 55 inserts into the quick-connect socket element 51 for filling of the bottle. Check valves in the insert 55 and the socket 51 prevent fluid flow when the two elements are disconnected. When insert 55 is inserted into socket 51, the check valves are opened and fluid is free to flow from the bladder 90 to the bottle 63 via the tube 27.

FIG. 5A shows the bottle 10 removed from the socket support panel 53 attached to the right elastic fabric waistband 41; stitching, adhesive, rivets are all possible means for attachment to the waistband. The quick-connect insert 55 is visible, and the dashed line shows how the insert 55 is inserted into the quick-connect socket 51 attached to the socket support panel 53. FIG. 5B shows the bottle 10 after the quick-connect insert 55 has been inserted into the quick-connect socket 51. The configuration of the socket 51 and socket support panel 53 are such that the loop fastener 65 and the hook fastener 43 do not engage during insertion or removal of the bottle 10, thus allowing unimpeded insertion and disengagement of the quick-connect insert 55 with the quick-connect socket 51. The socket support panel 53 is constructed of semi-pliable plastic such that after insertion of insert 55 into socket 51, the bottle 10 can be pressed against the socket support panel 53 such that the hook fastener 43 engages the loop fastener 65, seen in FIG. 5C, thus preventing disengagement of the fluid coupling consisting of quick-connect insert 55 and quick-connect insert 51.

FIGS. 6A and 6B show how the bottle 10 shown in FIGS. 1, 2, and 3 dispenses fluid and is filled. When the bottle 63 is squeezed by the fingers of a hand 48, fluid exits the bottle 63 via a dispensing nozzle or spout with check-valve 71 biased to allow fluid to flow only out of the bottle in the direction of the arrow. This biasing of fluid flow prevents air from infiltrating the bottle when the user releases the bottle. The bottle 63 also contains at the bottom the check valve 61 to which the tube 27 is attached and from which water flows from the bladder 90 when the bottle is released from the grip of the fingers 48 of the user. The valve is biased to allow fluid to flow only into the squeeze bottle 10 in the direction of the arrow seen in FIG. 6B; this biasing prevents backflow of fluid from the bottle 63 into the bladder 90.

FIGS. 7A, 7B, and 7C show the configuration of the bottle 10 shown in FIGS. 4, 5A, 5B, and 5C. When squeezed by the fingers 48, fluid exits via the dispensing nozzle or spout with check valve 71, which is biased to prevent air from infiltrating the bottle 63. The quick-connect insert 55 has an integral check valve, which remains closed unless engaged with the quick-connect socket 51. When released from the user's grip as seen in FIG. 7B, no air is allowed to infiltrate the bottle 63, due to the action of the check valve spout 71 and the quick-connect insert 55 which allows flow only when engaged with the quick-connect socket 51. When the quick-connect insert 55 is inserted into quick-connect socket 51, the fluid coupling is completed, the check valves of the quick-connect insert 55 and quick-connect socket 51 are disengaged, and fluid is free to flow into the bottle 63.

FIGS. 8A and 8B show the front and rear views respectively of the bladder 90, which is composed of two apposed sheets of flexible water-impermeant plastic material. Food- or beverage-grade polyvinylchloride, polyolefin, polyurethane and polyethylene are some of the many suitable plastics available for construction, but others that are approved for food and beverage use, are sufficiently pliable, water-impermeant, and readily seamed may also be suitable. The front sheet 91 is attached to a rear sheet 93 by seaming about the outer edges; the method of seaming may be adhesive, thermal, radio frequency, or ultrasonic depending on the requirements of the sheeting. The cap 11 is attached to the opening 12 on the front sheet 91. The cap 11 contains a small hole or orifice 13 into which the tube 27 is inserted, thus providing means for exit of fluid from the bladder 90. Attached to the front sheet 91 is a snap element 92, which engages a complementary rear snap element 94, which attaches to the rear bladder sheet 93. The snap elements 92 and 94, when engaged, position a small portion of the front bladder sheet 91 in apposition with a small portion of the rear bladder sheet 94. Because of gravity, fluid will tend to pool at the bottom of bladder 90; snapping the bladder 90 together at this point pinches the bladder to allow uniform distribution of the fluid. Because the snaps 92 and 94 can be unsnapped, cleaning and air-drying of the interior of the bladder 90 is easier than if the bladder 90 were permanently welded together at the location where the snaps 92 and 94 are located.

FIGS. 9A and 9B are cross-sectional views taken through the line 9 in FIG. 8A and show more clearly the effect of the snap elements 92 and 94 on fluid distribution in the bladder 90. FIG. 9A shows the bladder 90 fully filled with fluid and without engagement of the snaps 92 and 94. Because of gravity, fluid pools in the bottom of the bladder 90, resulting in an uneven distribution of fluid and an increase of distance of the center of mass of the bladder 90 to the user who is in apposition to the rear face 93. FIG. 9B shows the effect of engaging the snap elements 92 and 94, with the result that the lower portion of the bladder 90 is pinched, thus forcing fluid higher up into the bladder 90. The snap elements 92 and 94 have an additional function, which is to dampen the movement of fluid within the bladder 90, and this dampening helps to reduce overall motion of the bladder 90.

FIG. 10A shows a prior art hydration pack 20*a* with an outer fabric layer 21*a* which attaches to a left fabric waistband 47*a* and a right fabric waistband 41*a* which constrains the pack 20*a* about the user's waist. FIGS. 11A and 11B are cross-sections through the line 11 in FIG. 10A. The outer fabric layer 21*a* is joined to an inner fabric layer 22*a*, which apposes the user's, waist. The fabric layers 21*a* and 22*a* define the compartment or pack 20*a* into which a bladder 90*a* is inserted. Because the fabric layers 21*a* and 22*a* are typically constructed of non-elastic fabrics such as nylon or polyester pack cloth, the volume of the interior of the pack defined as the region between layers 21*a* and 23*a* is constant. The volume of the bladder 90*a* is variable, however, as a function of the volume of fluid contained therein. Although the bladder 90*a* when full presents a snug fit in FIG. 11A, when the bladder 90*a* is partially drained during use as in FIG. 11B, the volume of the bladder 90*a* is reduced while the volume of the pack 20*a* remains constant, and thus the bladder 90*a* is free to bounce around within the pack 20*a*.

FIG. 10B shows the present invention. The outer fabric layer 21 attaches to a left fabric waistband 47 and a right fabric waistband 41 which constrain the pack 20 about the user's waist. FIGS. 12A, 12B, and 12C are cross sections taken through the line 12 in FIG. 10B. FIG. 12A shows the pack 20 without the bladder 90 and without the compression plate 95. The outer fabric layer 21 is attached to the inner fabric layer 22 and is constrained about the user's waist by the attached left fabric waistband 47 and right fabric waistband 41. The volume of the interior of the pack 20 is defined by the region enclosed by outer fabric layer 21 and the inner fabric layer 22. Here it can be seen that without the bladder, the volume of the unloaded pack is zero. Therefore, given that the bladder 90 has a volume equal to the fluid volume contained therein, insertion of the bladder 90 into the pack 20 produces an increase in volume of the interior of the pack 20 and this must be accomplished through the act of stretching the inner fabric layer 22 and the outer fabric layer 21. Given that the back of the user approximates a flat planar surface, the outer fabric layer 21 will undergo a larger amount of stretch than the inner fabric layer 22. As seen in FIG. 12B, when the full bladder 90 is inserted into the pack 20, the outer fabric layer 21 stretches a greater amount than the inner fabric layer 22, and thus, relative to the inner fabric layer 22, there is greater tension in the outer fabric layer 21, thus producing a force against the bladder 90 such that the bladder 90 is maintained in compression against the user's back. Unlike the prior art pack shown in FIG. 10A, the volume of the pack 20 of the present invention changes as a function of the volume of the bladder 90 contained within the pack 20. Furthermore, unlike the prior art pack 20*a* shown in FIGS. 10A, 11A, and 11B, the pack 20 is prestressed upon loading of the bladder 90.

The tension in the outer fabric layer 21 is self-adjusting, because this tension is proportional to the amount of stretch in the outer fabric layer 21, and this is a function of the volume of the bladder 90. When the bladder 90 is fully loaded, the necessary tension to restrain it is greater, and because of the increased stretch of the outer fabric layer 21, tension is increased. When the bladder 90 is empty, as it may be towards the end of a run, the tension needed to restrain the bladder 90 is minimal; because of the decreased stretch of the outer fabric layer 21, tension is likewise decreased.

FIG. 13 is a cross-section through the lines 13 in FIG. 10B. As seen in FIG. 9A, when the snaps 92 and 94 are not engaged, fluid pools in the lower portion of the bladder 90. In FIG. 9B, engaging of the front snap 92 with the rear snap 94 acts to pinch the lower portion of the bladder 90 such that fluid is forced upwards. However, because of gravity, fluid will still tend to pool in the lower portion of the bladder 90. To produce a uniform distribution of fluid in the vertical direction, greater pressure must be exerted on the lower portion of the bladder 90 where the fluid pools. As seen in FIG. 13, the compression plate 95 acts to distribute the force of the tensioned outer fabric layer 21 more uniformly across the bladder 90; this, along with the constriction provided by the snap elements 92 and 94, ensures that the fluid does not pool in the lower region but is instead distributed more evenly from top to bottom. Furthermore, the constriction of the snaps 92 and 94 and the action of the compression plate 90 both serve to dampen motion of the pliable bladder 90, resulting in increased motion control. Although semi-rigid, because the compression plate 90 is against the outer face of the bladder, the user only feels the soft pliable bladder and not the rigid plate, a feature which increases comfort.

DESCRIPTION AND OPERATION OF ALTERNATIVE EMBODIMENTS

Although the above description contains many specificities, these should not be construed as limiting the scope of the invention but as merely providing illustrations of some of the preferred embodiments of this invention. For example, although the tube 27 is shown inserted into the cap 11, it could also be directly inserted into the bladder 90, either directly, or via an adapter or other configuration that provides for the lumen of the tube to be contiguous with the interior of the bladder. Furthermore, direct insertion of the tube into the bladder would allow other embodiments for filling the bladder; for example, the cap could be replaced with a zip-top closure or a roll-down closure. The tube could also be wrapped in an insulating outer layer to lessen warming of the fluid in the tube during hot weather. The bladder 90 is shown as ovoid, however, it may be constructed in a variety of shapes, such as circular, or rectangular, or elliptical, with the long axis oriented either in the horizontal or vertical directions.

The bottle 10 could be attached to either the left or the right side, depending on the preference of the user. The bottle shown here has an elliptical cross-section, but other shapes might be desirable. For example, the face that apposes the waist could be flattened so that the cross-section approximates a semi-circle; this might provide greater contact between hook and loop fastener elements. In addition to the bottle 10 used to provide hydration from the main bladder 90, it might also be desirable to include an additional bottle that is not attached to the main bladder. This bottle could be mounted with hook and loop elements on the side opposite the bottle 10, and could be filled with carbohydrate solution. Furthermore, although hook and loop fastener is the preferred means of attachment, the bottle 10 could also be constrained by means of a small pocket of fabric that would function as a holster. Other embodiments might include a clip or a snap element on the waistband and bottle 10 such that the bottle would clip or snap firmly onto the waist.

The pack 20 as shown attaches to elastic fabric waistbands, which then attach to straps connecting to the buckle elements. It would be possible to eliminate the waistbands, straps, or both, such that the pack fabric attaches either directly to the straps or directly to the buckles. This would result in greatly simplified construction, offsetting the increased waste of fabric that would result from cutting out such a large and irregular piece of fabric. Buckles could also be replaced by hook and loop fastener, or fasteners could be eliminated and the entire pack could be constructed such that it comes in a variety of sizes and could be slipped on as a single unit much like a sport bra or undergarment.

The outlet check valve 71 may be chosen from the group of check valves that includes the following: ball, flap, disk, diaphragm, or reed. The specific type is not shown here because the functional results are similar. Likewise, there are many different acceptable types of commercially available quick-connect couplings composed of the socket 51 and insert 55 described herein. For example, although the coupling shown herein relies on a simple linear insertion of the insert 55 into the socket 55, other quick-connect couplings utilize insertion followed by a quarter-turn twist to secure the coupling.

CONCLUSION, RAMIFICATIONS, AND SCOPE OF INVENTION

Accordingly, the reader will see that the hydration system for runners described herein represents a significant improvement over previous designs, and solves a long-felt need for runners, particularly those who reside in hot climates. The flexible bladder can be filled with up to several liters of cold liquid along with large quantities of ice to ensure that the fluid contained within will remain cold through long hot runs. The flexible, elastic, and thermally-insulating fabric pack attaches securely about the waist, provides superior motion control without restricting movement of the runner's musculature or other soft tissue, and is unobtrusive due to its low profile. The pack is pre-stressed and self-adjusting to provide tension as the bladder volume changes. Delivery of ice-cold liquid is a simple one-handed operation, as the user simply removes the small squeeze bottle from the waist-band, raises it to the mouth, and squeezes. The squeeze bottle fills automatically, and thus the user does not have to perform any other actions besides dispensing.

I claim:

1. A hydration system for runners comprising:

a) a waist pack formed by joining two sheets of flexible, elastic, and thermally-insulating fabric about the perimeter and containing means for securing about the waist;

b) a flexible bladder for containment of fluid, said bladder having a fluid holding capacity of between about 1 and 3 liters, and contained within said waist pack;

c) a flexible dispensing hose attached at one end to said bladder and attached at the opposite end to a dispensing bottle, said hose being of sufficient length to allow the dispensing bottle to be raised to the user's mouth for dispensing;

d) a dispensing bottle of size sufficient to dispense a single serving of fluid, and comprising a flexible plastic squeeze bottle, said bottle having a fluid capacity of about 100 to 200 mls, said bottle being enrobed in a thermally insulating fabric with attachment means for securing to the user's waist; an inlet check valve connecting at one end to said dispensing tube and at the other end to said squeeze bottle, said inlet check valve providing means for biasing flow from tube to squeeze bottle; an outlet check valve connecting at one end to said squeeze bottle and open at the other end to the exterior of said squeeze bottle, said outlet check valve further providing means for biasing flow from the interior to the exterior of said squeeze bottle, thus preventing air infiltration into said squeeze bottle.

2. The system of claim 1 wherein said bladder contains at least one pair of snap elements, said snap elements providing means for bringing into apposition a portion or portions of said bladder.

3. The system of claim 1 and further including a semi-rigid plastic compression plate inserted into said pack between the exterior face of said bladder and external face of said pack, said compression plate providing means to distribute evenly the pressure on said bladder exerted by the external face of said pack.

4. The system of claim 2 and further including a semi-rigid plastic compression plate inserted into said pack between the exterior face of said bladder and external face of said pack, said compression plate providing means to distribute evenly the pressure on said bladder exerted by the external face of said pack.

5. The system of claim 1 and further containing a badge reel attaching to said hose and providing means for restraining hose when not in use.

6. The system of claim 5 wherein said bladder contains at least one pair of snap elements, said snap elements providing means for bringing into apposition a portion or portions of said bladder.

7. The system of claim 5 and further including a semi-rigid plastic compression plate inserted into said pack between the exterior face of said bladder and external face of said pack, said compression plate providing means to distribute evenly the pressure on said bladder exerted by the external face of said pack.

8. The system of claim 6 and further including a semi-rigid plastic compression plate inserted into said pack between the exterior face of said bladder and external face of said pack, said compression plate providing means to distribute evenly the pressure on said bladder exerted by the external face of said pack.

9. A hydration system for runners comprising:

e) a waist pack formed by joining two sheets of flexible, elastic, and thermally-insulating fabric about the perimeter and containing means for securing about the waist, f) a flexible bladder for containment of fluid, said bladder having a fluid holding capacity of between 1 and 3 liters, and contained within said waist pack;

g) a flexible dispensing hose attached at one end to said bladder and attached at the opposite end to a quick-connect coupling socket element attached to a semi-rigid plate, said plate being attached to the waistband and providing means to hold said socket securely about the waist of the user;

h) a dispensing bottle of size sufficient to dispense a single serving of fluid, and comprising a flexible plastic squeeze bottle, said bottle having a fluid capacity of about 100 to 200 mls, said bottle being enrobed in a thermally insulating fabric with attachment means for securing to the user's waist; a quick-connect coupling insert element which couples to said quick-connect socket at one end and at the other end to said squeeze bottle, said quick-connect insert containing an integral check valve providing means for biasing flow from quick-connect socket to squeeze bottle such that flow is permitted only when the insert and socket are engaged;

an outlet check valve connecting at one end to said squeeze bottle and open at the other end to the exterior of said squeeze bottle, said outlet check valve further providing means for biasing flow from the interior to the exterior of said squeeze bottle thus preventing air infiltration into said squeeze bottle.

10. The system of claim 9 wherein said bladder contains at least one pair of snap elements, said snap elements providing means for bringing into apposition a portion or portions of said bladder.

11. The system of claim 9 and further including a semi-rigid plastic compression plate inserted into said pack between the exterior face of said bladder and external face of said pack, said compression plate providing means to distribute evenly the pressure on said bladder exerted by the external face of said pack.

12. The system of claim 10 and further including a semi-rigid plastic compression plate inserted into said pack between the exterior face of said bladder and external face of said pack, said compression plate providing means to distribute evenly the pressure on said bladder exerted by the external face of said pack.

* * * * *